US012630900B2

(12) United States Patent
Maccagni et al.

(10) Patent No.: US 12,630,900 B2
(45) Date of Patent: May 19, 2026

(54) METHOD FOR RECOVERING METAL ZINC FROM SOLID METALLURGICAL WASTES

(71) Applicant: ENGITEC TECHNOLOGIES S.P.A., Novate Milanese (IT)

(72) Inventors: Massimo Giuseppe Maccagni, Sesto San Giovanni (IT); Edoardo Guerrini, Chiari (IT); Andrea Grassi, Sedriano (IT)

(73) Assignee: ENGITEC TECHNOLOGIES S.P.A., Novate Milanese (IT)

( * ) Notice: Subject to any disclaimer, the term of this patent is extended or adjusted under 35 U.S.C. 154(b) by 711 days.

(21) Appl. No.: 17/760,230

(22) PCT Filed: Feb. 10, 2021

(86) PCT No.: PCT/IB2021/051062

§ 371 (c)(1),
(2) Date: Aug. 5, 2022

(87) PCT Pub. No.: WO2021/161178

PCT Pub. Date: Aug. 19, 2021

(65) Prior Publication Data

US 2023/0083759 A1 Mar. 16, 2023

(30) Foreign Application Priority Data

Feb. 10, 2020 (IT) ..... 102020000002515

(51) Int. Cl.
*C22B 3/00* (2006.01)
*C22B 3/14* (2006.01)
(Continued)

(52) U.S. Cl.
CPC ..... *C22B 19/26* (2013.01); *C22B 3/14* (2013.01); *C22B 3/46* (2013.01); *C25C 1/16* (2013.01)

(58) Field of Classification Search
None
See application file for complete search history.

(56) References Cited

U.S. PATENT DOCUMENTS 4,067,789 A 1/1978 Harris et al.
4,292,147 A 9/1981 Fray et al.
5,833,830 A 11/1998 Gonzalez Dominguez et al.

FOREIGN PATENT DOCUMENTS

AU 710302 B2 9/1999
AU 2002328671 B2 11/2008
(Continued)

OTHER PUBLICATIONS

English translation of WO-2015162902-A1 Description. (Year: 2015).*

(Continued)

*Primary Examiner* — Anthony J Zimmer
*Assistant Examiner* — Zachary John Baum
(74) *Attorney, Agent, or Firm* — Oblon, McClelland, Maier & Neustadt, L.L.P.

(57) ABSTRACT

A method for recovering metal zinc from a solid metallurgical waste containing zinc and manganese, may include: (a) bringing the solid metallurgical waste into contact with an aqueous leaching solution comprising chloride ions and ammonium ions to produce at least one leachate including zinc ions and manganese ions and at least one insoluble solid residue; (b) cementing the leachate, by adding metal zinc as a precipitating agent, to eliminate at least one metal other than zinc and manganese possibly present in the leachate as ions and producing a purified leachate; (c) subjecting the purified leachate to electrolysis in an electrolytic cell including at least one cathode and at least one anode immersed in the purified leachate to deposit metal zinc on the cathode and producing at least one exhausted leachate, and, before the (Continued)

electrolysis, precipitating manganese ions by oxidation with permanganate ions and subsequently separating a precipitate including $MnO_2$.

17 Claims, 1 Drawing Sheet

(51) Int. Cl.
*C22B 3/46* (2006.01)
*C25C 1/16* (2006.01)

(56) References Cited

FOREIGN PATENT DOCUMENTS

| | | | | |
|---|---|---|---|---|
| CN | 103359775 | A1 | 10/2013 | |
| EP | 0 551 155 | A1 | 7/1993 | |
| EP | 0 630 856 | A1 | 12/1994 | |
| EP | 3 333 272 | A1 | 6/2018 | |
| EP | 3 587 603 | A1 | 1/2020 | |
| FR | 3 034 105 | A1 | 9/2016 | |
| JP | 56-9383 | A | 1/1981 | |
| JP | 10-509212 | A | 9/1998 | |
| RU | 2 298 585 | C9 | 8/2007 | |
| WO | WO 96/08585 | A1 | 3/1996 | |
| WO | WO 03/023077 | A1 | 3/2003 | |
| WO | WO-2015162902 | A1 * | 10/2015 | ..... B09B 3/35 |

OTHER PUBLICATIONS

S. Ramachandra Rao et al, "Metallurgical Slags, Dust and Fumes" In: *Resource Recovery and Recycling from Metallurgical Wastes In: Waste Management Series*, vol. 7, Jan. 1, 2006, XP055741770, 60 pages.

Zhang et al: "Manganese metallurgy review. Part III: Manganese control in zinc and copper electrolytes", *Hydrometallurgy, Elsevier Scientific Publishing Cy.*, vol. 89, No. 3-4, Oct. 25, 2007, XP022314561, 11 pages.

International Search Report mailed on May 27, 2021 in PCT/IB2021/051062 filed on Feb. 10, 2021 (4 pages).

Saudi Arabian Office Action issued May 2, 2023 in Saudi Arabian Patent Application No. 522440082, 6 pages.

Combined Chinese Office Action and Search Report issued on Jun. 3, 2023 in Chinese Patent Application No. 202180013514.9 (with English translation), 16 pages.

Office Action issued Sep. 2, 2023, in corresponding Saudi Arabia Patent Application No. 522440082 (with English Translation), 8 pages.

Japanese Office Action issued Feb. 12, 2025, in corresponding Japanese Patent Application No. 2022-547792 (with English Translation), 12 pages.

Combined Russian Office Action and Search Report issued Jun. 28, 2024, in corresponding Russian Patent Application No. 2022122590 (with English Translation), 11 pages.

* cited by examiner

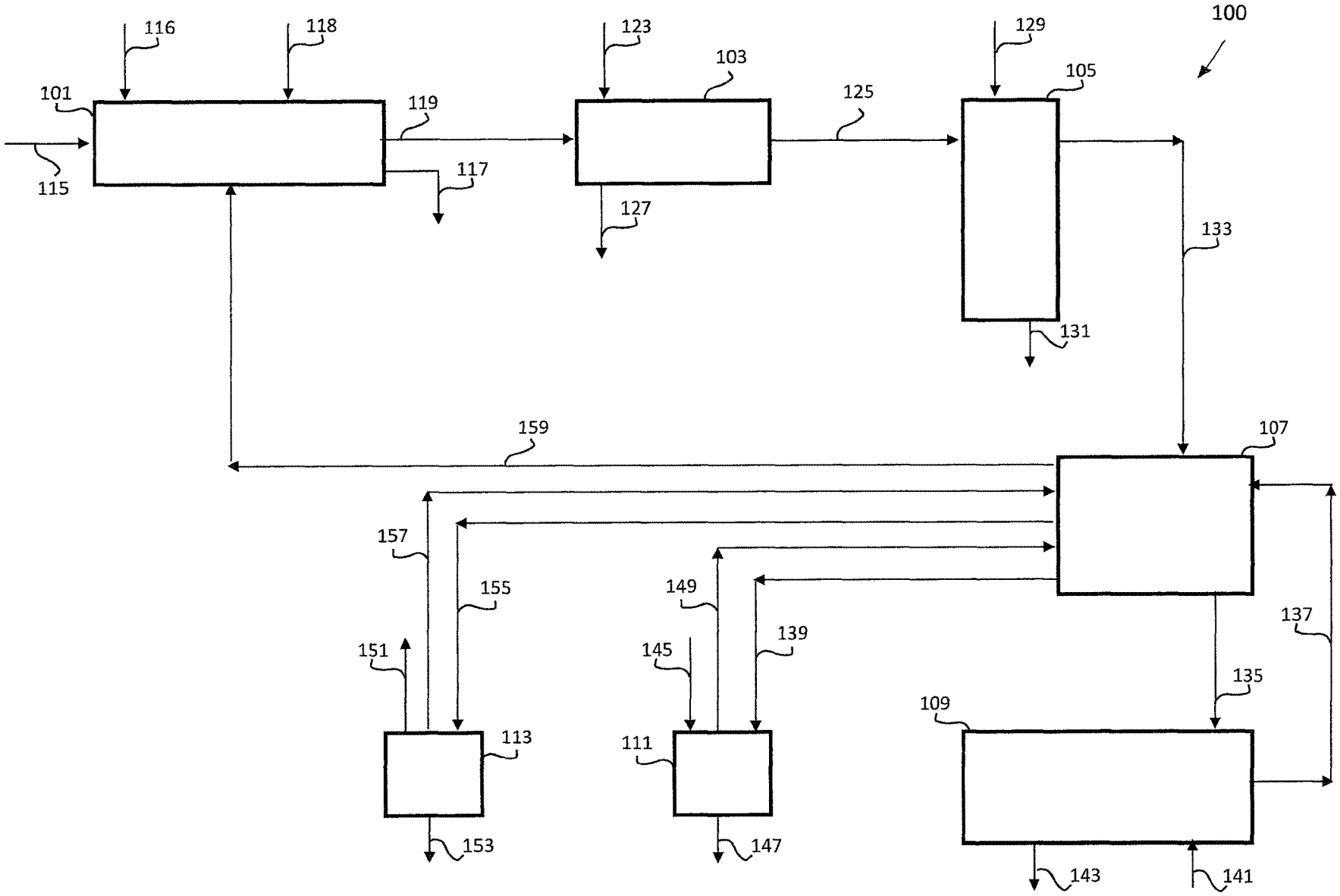
100
101
103
105
107
109
111
113
115
116
117
118
119
123
125
127
129
131
133
135
137
139
141
143
145
147
149
151
153
155
157
159

METHOD FOR RECOVERING METAL ZINC FROM SOLID METALLURGICAL WASTES

CROSS-REFERENCE TO RELATED APPLICATIONS

The present application is the national stage of international application PCT/IB2021/051062, filed on Feb. 10, 2021, and claims the benefit of the filing date of Italian Appl. No. 10 2020 000002515, filed on Feb. 10, 2020.

FIELD OF THE INVENTION

The present invention relates to a method for recovering metal zinc from solid metallurgical wastes.

BACKGROUND OF THE INVENTION

In the metallurgical industry, large quantities of solid wastes are produced, such as dusts and slag, containing high quantities of zinc and other metals, such as lead and nickel. For example, huge quantities of dusts (EAF dusts) having a relatively high zinc content (about 20-40% by weight) are produced in steelworks that use an electric-arc furnace (EAF) for the production of secondary steel. Other metallurgical wastes containing zinc are generated, for example, by processes in the galvanic industry. In general, in metallurgical wastes, zinc is present in the form of metal, oxides and/or alloys in association with other elements, such as lead, cadmium, copper, silver, manganese, alkaline and alkaline-earth metals and halides, which are present in variable concentration according to the process of origin.

In the state of the art there is a strong need to recover the zinc present in metallurgical wastes in order to reuse it as a secondary raw material in industrial processes. Such recovery, in fact, allows to reduce the consumption of zinc as raw material, the management costs of metallurgical wastes (e.g., waste disposal) and therefore the environmental impact of production processes, such as hot or electrolytic zinc coating deposition processes or processes for the production of metal alloys.

Both pyrometallurgical and hydrometallurgical processes have been known and used for some time for the recovery of zinc from metallurgical wastes.

A pyrometallurgical process that is widely used for treating wastes such as EAF dusts is the Waelz process. In this process, the metallurgical wastes containing zinc are treated at high temperature in order to volatilize the metal zinc contained in the wastes and then recover it in the form of concentrated oxide (ZnO). The zinc oxide thus obtained, also known as crude zinc oxide (CZO), has a zinc content of about 60% by weight and significant quantities of heavy metal impurities (e.g., PB, CD, Mn) and halides. The CZO is subsequently treated by means of pyrometallurgic processes (e.g., Imperial Smelting) or hydrometallurgic processes (e.g., leaching in sulphuric acid and subsequent cathodic electrodeposition) in order to obtain metal zinc.

The main disadvantages of pyrometallurgical methods are the high energy requirement and the need for a complex system for collecting and purifying the gaseous effluents produced in the process. The presence of halides in the CZO, in addition to causing serious problems of corrosion of the plants, negatively affects the process of catalytic electrodeposition of zinc, reducing the effectiveness thereof. In order to overcome at least partially this drawback, the CZO is generally subjected to a water washing pre-treatment to remove the halides, before subjecting it to leaching with sulphuric acid.

One of the hydrometallurgical processes proposed in the state of the art for the recovery of zinc from metallurgical wastes is the EZINEX® process. This process is described for example in U.S. Pat. Nos. 5,468,354A, 5,534,131A and in M. Maccagni, *J. Sustain Metall.* (2016) 2:133-140. The EZINEX® process is a process carried out continuously comprising the steps of: leaching metallurgical wastes in a leaching solution of ammonium chloride; purifying leachate obtained by cementing; separating metal zinc from the leachate by electrodeposition.

In the leaching step of the EZINEX® process, the metallurgical wastes are brought into contact with an aqueous solution of ammonium chloride at neutral pH to obtain a solution containing, in the form of ions, zinc and the other leachable metals present in the metallurgical wastes and an insoluble residue. The process of dissolving the metals in the leaching solution can be schematically represented by the following reaction:

$$MeO_{n/2}+n\ NH_4Cl \rightarrow Me(NH_3)_nCl_n+n/2H_2O \quad (1)$$

wherein Me, for example, represents $Zn^{2+}$, $Cd^{2+}$, $Cu^{2+}$ $Cu^{+}$, $Ag^{+}$ or $Mn^{2+}$, and n is equal to 1 or 2.

The leaching carried out at neutral pH prevents the ions or iron present in the metallurgical wastes from dissolving which, in its trivalent state, is insoluble in the leachate under these pH conditions.

The step of purifying the leachate containing the zinc ions is generally carried out by cementing metals other than zinc using metal zinc dust as a precipitating agent. The addition of metal zinc to the leachate causes precipitation of the metals having a higher (or more positive) reduction potential than the reduction potential of the zinc. The precipitated metals are then removed from the leachate by filtration.

The process for cementing the metals other than zinc can be schematically represented by the following reaction:

$$Me^{n+}+n/2\ Zn \rightarrow Me+n/2\ Zn^{2+} \quad (2)$$

wherein Me, for example, represents $Pb^{2+}$, $Cd^{2+}$, $Cu^{2+}$ $Cu^{+}$ or $Ag^{+}$, and n is equal to 1 or 2.

The thus purified leachate containing the zinc ions is then subjected to electrolysis to separate metal zinc in the elemental state. Electrodeposition is generally carried out by continuously feeding the leachate to an electrolytic cell equipped with at least one cathode, generally of titanium, and at least one anode, generally of graphite.

The reactions involved in the electrolysis process are schematically as follows:

to the cathode:

$$Zn(NH_3)_2Cl_2+2e^- \rightarrow Zn+2\ NH_3+2\ Cl^- \quad (3),$$

to the anode:

$$2\ Cl^- \rightarrow Cl_2+2e^- \quad (4).$$

The chlorine generated by reaction (4) is rapidly converted into $Cl^-$ ions near the anode with evolution of gaseous nitrogen, for example as schematically represented by the following reaction:

$$Cl_2+\tfrac{2}{3}NH_3 \rightarrow \tfrac{1}{3}N_2+2\ HCl \quad (5)$$

The overall chemical reaction of the electrolytic cell can therefore be schematically represented by the following reaction:

$$Zn(NH_3)_2Cl_2+\tfrac{2}{3}NH_3 \rightarrow Zn+\tfrac{1}{3}N_2+2\ NH_4Cl \quad (6).$$

At the end of electrodeposition, the exhausted leachate is generally subjected to a regeneration treatment to eliminate impurities (e.g., halide ions, alkaline and alkaline-earth metal ions, transition metals) and water that have accumulated during the process, and then recycled in the leaching step. To this end, for example, the leachate is heat-treated to drive water away in the form of steam, thus also favouring the precipitation of impurities in the form of insoluble salts (in particular halide salts, e.g., NaCl, KCl). The regeneration treatment may further comprise a carbonation step by adding carbonate ions (for example, $Na_2CO_3$). The carbonation treatment allows to adequately reduce the concentration of calcium and magnesium ions, and in part of manganese ions, by precipitation of the relative insoluble carbonate salts, for example according to the following reaction:

$$Me(NH_3)_nCl_n+Na_2CO_3 \rightarrow MeCO_3+n\ NH_3+2\ NaCl \quad (7)$$

wherein Me, for example, represents $Mn^{2+}$, $Ca^{2+}$ or $Mg^{2+}$, and n is equal to 1 or 2.

One of the main advantages of the EZINEX® process compared to leaching CZO followed by electrodeposition of zinc in sulphuric acid is that it allows treating metallurgical wastes containing zinc, without subjecting them to preliminary washing treatments for the removal of halides.

The EZINEX® process, however, also has some drawbacks. The purified leachate, for example, can contain residual quantities of manganese ions and iron ions which, during electrolysis, can be oxidized to the anode and precipitate in the form of insoluble oxides, mainly $MnO_2$; $MnO_2$ can then be incorporated into the metal zinc deposited to the cathode, thus lowering the degree of purity of the zinc and the production yield of the electrolysis process.

The manganese ions, which are present in metallurgical wastes, tend, in fact, to accumulate in the leachate during the process, since they are only partially removed during the treatment of regeneration of the exhausted leachate (for example by means of the carbonation reaction (7)).

Iron ions, on the other hand, besides being leached by metallurgical wastes, are introduced into the leachate in not negligible quantities during cementation, iron being one of the main impurities of metal zinc generally used as a precipitating agent. Iron can be present in the leachate in soluble form, for example as a bivalent chlorine-ammoniacal complex $Fe(NH_3)_xCl_2$. A part of the iron dissolved in the leachate can oxidize to trivalent iron due to the oxygen in the air, for example according to the reaction $$Fe(NH_3)_xCl_2+\tfrac{1}{2}O_2+5\ H_2O \rightarrow 2\ Fe(OH)_3+4\ HCl+2x\ NH_3 \quad (8),$$

wherein x is an integer within the range 1-6, forming an insoluble residue that can be removed by filtration. The remaining part of the iron dissolved in the leachate reaches instead the electrolytic cell. During electrolysis, manganese ions and iron ions present in the leachate are oxidized by effect of the gaseous chlorine that develops to the anode (reaction 4), forming respective oxide and hydroxide species (e.g., $MnO_2$ and $Fe(OH)_3$), for example according to the following reactions:

$$Mn(NH_3)_xCl_2+Cl_2+2\ H_2O \rightarrow MnO_2+4\ HCl+x\ NH_3 \quad (9)$$

$$2\ Fe(NH_3)_xCl_2+Cl_2+6\ H_2O \rightarrow 2\ Fe(OH)_3+6\ HCl+2x\ NH_3 \quad (10)$$

where x is an integer within the range 1-6. These insoluble species gradually accumulate in the electrolyte and can be incorporated into the metal zinc particulate deposited at the cathode, lowering the degree of purity of the zinc.

During electrolysis, the manganese oxides incorporated in the cathodic deposit can be partially electrochemically reduced with formation of soluble $Mn^{2+}$ ions which are dispersed again in the electrolyte, for example according to the following reaction:

$$MnO_2+m\ NH_4Cl+\tfrac{2}{3}NH_3 \rightarrow Mn(NH_3)_mCl_2+\tfrac{1}{3}N_2+(m-2)HCl+2H_2O \quad (11)$$

where m is an integer within the range 1-6. In this case, despite not adversely affecting the purity of the deposited metal zinc, the presence of manganese ions in the leachate subjected to electrolysis, however, reduces the current efficiency of the cell, since the fraction of cathodic current used for the reduction of manganese ions is not available for the zinc electrodeposition. The energy consumption of the electrodeposition process is consequently higher.

Moreover, the formation of manganese oxides and hydroxides during electrodeposition makes the use of activated metal anodes (or dimensionally stable anodes) extremely costly, to the point that in practice this type of anodes is never used. As is known, activated metal anodes comprise a conductive substrate (for example of metal titanium) covered with a catalytic coating layer (active coating) containing noble metals and relative oxides (for example ruthenium, iridium, platinum, and relative oxides). In these anodes, sometimes also called MMO (Mixed metal oxide), the external active layer reduces the potential difference that must be applied to the electrodes in order to obtain the desired electrochemical reaction (in the case of the EZINEX® process, oxygen, and chlorine evolution) thus allowing to reduce the energy consumption with the same applied current density or to use higher current densities with the same overall energy consumption of the process.

In the EZINEX® process, the formation of manganese oxide is accompanied by the formation of incrustations strongly adhering to the anode surface. In the case of graphite anodes, such incrustations can have a positive effect, favouring the reaction of formation of gaseous chlorine. In the case of activated metal anodes, on the other hand, the formation of the $MnO_2$ incrustations causes the deterioration of the active catalytic layer and therefore imposes the interruption of the process for the regeneration of the anode, for example by redeposition of the active catalytic layer over the entire anode, with evident increase in costs and complexity of managing the zinc recovery process.

U.S. Pat. No. 5,833,830 describes a method for reducing the electrochemical formation of a precipitate of $MnO_2$ in a zinc electrodeposition process from a sulphuric electrolyte which contains it together with manganese ions. The described method provides for measuring the redox potential of the electrolyte in order to obtain a measured value, the comparison of the measured value with an optimal reference value and for adding a redox agent to the electrolyte to correct the redox potential of the latter to the reference value. The redox agent may be an oxidizing agent or a reducing agent. According to U.S. Pat. No. 5,833,830, the redox agent can be selected, for example, from peroxidic compounds (e.g., $H_2O_2$), sodium oxalate and sucrose. The addition of the redox agent, for example $H_2O_2$, to the electrolyte produces the dissolution of the oxide with formation of soluble $Mn^{2+}$ ions, thus avoiding the precipitation of $MnO_2$ to the anode and consequently prolonging the cell's operation. The dissolution of the $MnO_2$ species, however, produces the progressive accumulation of $Mn^{2+}$ ions in the electrolyte and, consequently, the interruption of the process when the concentration of these ions reaches the maximum tolerable concentration. The method described in U.S. Pat. No. 5,833,830, therefore, prevents the electrodeposition of $MnO_2$ without removing manganese from the electrolyte, but keeping it in soluble form in order not to compromise the activity of the anode.

SUMMARY OF THE INVENTION

It is an object of the present invention to overcome at least in part the drawbacks highlighted above which affect the methods of the prior art for recovering zinc from solid metallurgical wastes.

Within the scope of this general object, a specific object of the present invention is to provide a method for recovering zinc from solid metallurgical wastes, which allows to obtain metal zinc of high purity with lower costs than the known hydrometallurgical methods, in particular with respect to the EZINEX® process.

A second object of the present invention is to provide a method for recovering zinc from solid metallurgical wastes in which the electrodeposition step is characterized by a higher energy efficiency, in particular in the electrodeposition step.

A third object of the present invention is to provide a method for recovering zinc from solid metallurgical wastes, which is simpler to manage, requiring less frequent maintenance interventions for the maintenance of the electrodes.

A fourth object of the present invention is to provide a method for recovering zinc from solid metallurgical wastes in which the metal zinc electrodeposition can be carried out simply and effectively by using activated metal anodes, so as to reduce the energy consumption of the process.

A further object of the present invention is to provide a method for recovering zinc from solid metallurgical wastes in which it is possible to recover the manganese present in the process in the form of a product of relatively high purity and therefore reusable in other industrial processes.

The Applicant has found that the above and other objects, which will be better illustrated in the following description, can be achieved by treating the leachate containing zinc ions and manganese ions with $MnO_4^-$ ions, before subjecting it to electrodeposition, so as to remove the manganese ions from the leachate.

It has in fact been observed that by adding $MnO_4^-$ ions to the leachate it is possible to oxidize manganese ions, and iron ions which may be present, and to form respective insoluble species of manganese and iron oxide and hydroxide (e.g., $MnO_2$ and $Fe(OH)_3$), which can be easily separated from the leachate, so as to subject a leachate having an extremely low content of these two ions to electrolysis. In this way, the problem of accumulating manganese ions and iron ions in the electrolytic cell is effectively solved and the purity of the metal zinc deposited to the cathode is increased since a leachate in which substantially no particulate of these two metals is present is subjected to electrolysis.

Furthermore, the reduced concentration of manganese and iron ions in the leachate subjected to electrolysis reduces the overall energy consumption of the electrodeposition process and improves the current efficiency thereof, as the magnitude of the undesired electrochemical reactions taking place in the cell is reduced.

The substantial reduction in the concentration of manganese ions and iron ions in the leachate subjected to electrolysis, moreover, offers the advantage of reducing the formation of incrustations on the anodes, thus also making the use of activated metal anodes possible with consequent advantages in terms of production yield of the plant, which can operate continuously for extended periods requiring less frequent maintenance of the electrodes.

The activated metal anodes, moreover, have a thickness lower than that of the graphite anodes; their use therefore allows to reduce the size of the electrolytic cells used for electrodeposition compared to the cells with graphite anodes.

With the method described herein it is also possible to recover manganese, both the one already present in soluble form in the leachate and the one added as permanganate, in the form of $MnO_2$ having a high degree of purity. The method therefore allows to eliminate a contaminant from the leachate, converting it into a raw material which can be reused in other industrial processes.

Furthermore, since the manganese added in the form of permanganate ions is also recovered in the form of oxide, the method according to the present invention offers the particular advantage of eliminating manganese ions and iron ions without introducing further chemical elements or compounds into the leachate circulating in the plant.

In accordance with a first aspect, therefore, the present invention relates to a method for recovering metal zinc from a solid metallurgical waste containing zinc and manganese, comprising the steps of:

a. bringing said solid metallurgical waste into contact with an aqueous leaching solution comprising chloride ions and ammonium ions to produce at least one leachate comprising zinc ions and manganese ions and at least one insoluble solid residue;

b. cementing said leachate, by adding metal zinc as a precipitating agent, to eliminate at least one metal other than zinc and manganese possibly present in said leachate in form of ions and producing a purified leachate;

c. subjecting said purified leachate to electrolysis in an electrolytic cell comprising at least one cathode and at least one anode immersed in said purified leachate to deposit metal zinc on said cathode and producing at least one exhausted leachate;

said method comprising, before said electrolysis, a step of precipitating manganese ions by oxidation with permanganate ions and subsequent separation of a precipitate comprising $MnO_2$.

The oxidation of soluble manganese ions ($Mn^{2+}$) in the leachate by addition of permanganate ions ($MnO_4^-$) can be carried out in one or more points in the process.

In one embodiment, permanganate ions are added to the purified leachate exiting from said step b, for example in a dedicated treatment unit for precipitating and removing manganese ions.

In another embodiment, the $MnO_4^-$ ions are added to the leaching solution used in step a. In this case, the precipitated manganese oxide $MnO_2$ is removed together with the insoluble residue of the leached metallurgical wastes. This embodiment is particularly advantageous when the manganese concentration in the leachate is relatively low, preferably lower than or equal to 1 g/l. It may not be economically convenient to install a dedicated treatment unit below this concentration.

In one embodiment, the $MnO_4^-$ ions added to the exhausted leachate exiting from step c, which is recycled as a leaching solution in said step a.

In a particularly preferred embodiment, the $MnO_4^-$ ions are fed to the leachate circulating in the plant, at the pre-selected point, maintaining the redox potential of the leachate at an optimal reference value, wherein said optimal value is obtained by means of a calibration curve which takes into account at least the pH of the leachate, preferably of the pH and the temperature of the leachate.

Further characteristics of the process according to the present invention are defined in the dependent claims.

As used in the present description and in the appended claims, the articles "a/one" and "the" must be read as including one or at least one and the singular as also including the plural, unless it is obvious that it is intended otherwise. This is done only for convenience and to give a general sense of the description.

Unlike the embodiments, or where otherwise indicated, all the numbers expressing quantities of ingredients, reaction conditions, and so on, used in the disclosure and claims are to be understood as modified in all cases by the term "about".

The numerical limits and intervals expressed in the present description and appended claims also include the numerical value or numerical values mentioned. Furthermore, all the values and sub-intervals of a limit or numerical interval must be considered to be specifically included as though they had been explicitly mentioned.

The compositions according to the present invention may "comprise", "consist of" or "consist essentially of the" essential and optional components described in the present description and in the appended claims.

For the purposes of the present description and the appended claims, the term "essentially consists of" means that the composition or component may include additional ingredients, but only to the extent that the additional ingredients do not materially alter the essential characteristics of the composition or component.

For the purposes of the present description and appended claims, the concentration of ions of a metal in solution is expressed in terms of said metal in the elemental state, unless it is obvious that it is intended otherwise.

DESCRIPTION OF THE FIGURES

The characteristics and advantages of the process according to the present invention will be more evident from the following description referring to the attached FIG. 1, which is a schematic representation of an embodiment of the method according to the present invention. The following description and the following examples of embodiment are provided for the sole purpose of illustrating the present invention and are not to be understood in a sense limiting the scope of protection defined by the appended claims.

DETAILED DESCRIPTION OF THE INVENTION

With reference to FIG. 1, a system 100 comprises a unit for leaching 101 metallurgical wastes, a cementing unit 103 for the removal of metals other than zinc and manganese, an oxidation unit for the removal of $Mn^{2+}$ ions soluble in the form of a precipitate comprising $MnO_2$ 105, an electrolyte recycling tank 107, an electrodeposition unit 109 for the electrodeposition of zinc, a carbonation unit 111 and an evaporation unit 113 for the regeneration of the exhausted electrolyte. The following description of the method according to the present invention relates to a mode of carrying out continuously said method and in a steady state condition.

During the implementation of the method according to the present invention, the metallurgical wastes containing zinc and manganese 115 are fed to the leaching unit 101, where they are brought into contact with a leaching solution comprising $NH_4^+$ ions and $Cl^-$ ions which is fed for example in the form of ammonium chloride solution 116.

Preferably, metallurgical wastes include EAF, CZO dust and other wastes containing zinc in oxidized form generated by metallurgical processes, such as ash, slag, and sludge. More preferably, metallurgical wastes comprise at least one of: EAF, CZO dusts and mixtures thereof.

Zinc and manganese can be present in metallurgical wastes in the form of metal, oxide and/or alloy. The zinc content in metallurgical wastes is preferably within the range 15%-70% by weight. The Mn content is preferably within the range of 0.1%-10% by weight, more preferably 0.5%-5% by weight.

In addition to manganese, metallurgical wastes can contain other contaminants, such as halides (in particular fluorides) and metals (in particular Pb, CD, Cu, Fe, Ni, AG, alkaline and alkaline-earth metals, in particular Na and Ca). The overall concentration of metal contaminants and fluorides in metallurgical wastes varies depending on the origin of the wastes. Preferably, the overall concentration of metal contaminants, excluding manganese, is within the range 2%-5% by weight, while the overall concentration of halogens is within the range 2%-10% by weight (expressed as $X_2$, where X is a halogen atom, for example Cl or F), said percentages being referred to the weight of the metallurgical waste.

The leaching step generates a biphasic reaction product comprising an insoluble residue 117 and a leachate 119 comprising zinc ions and manganese ions. The leachate 119 further comprises the other metal contaminants present in the metallurgical wastes which are dissolved during leaching. The dissolved metals are present in the leachate in the form of ions, in particular chlorine-ammoniacal complexes which are formed, for example, according to reaction 1 shown previously.

The ammonium and chloride ions are preferably contained in the leaching solution in a variable concentration within the range 100 g/l-600 g/l expressed as ammonium chloride.

Preferably, the pH of the leaching solution is within the range 5-9, more preferably within the range 5.2-7.5, more preferably within the range 6-7. Under these pH conditions, the leaching of the iron contained in the treated metallurgical waste is minimized. The pH of the leaching solution can be controlled by adding an aqueous solution of $NH_3$.

Leaching is preferably carried out at a temperature within the range 50° C.-90° C., more preferably 60° C.-80° C.

At the end of the leaching, the insoluble residue 117 is separated from the leachate 119, for example by decantation and/or filtration. The insoluble residue consists mainly of zinc ferrite and iron oxides. The insoluble residue may further comprise $CaF_2$ deriving from the precipitation of the fluoride ions and calcium ions present in the treated metallurgical waste. The insoluble residue can be sent to disposal as a waste or more advantageously recycled to an EAF furnace for the production of steel or to a process for the production of CZO.

In one embodiment, the oxidation of soluble manganese ions and possibly soluble iron ions is carried out by adding $MnO_4^-$118 ions to the leaching solution. In this case, the insoluble residue 117 also comprises a precipitate of $MnO_2$ and optionally of $Fe(OH)_3$.

In the cementing unit 103, the leachate 119 is subjected to a cementing treatment to remove contaminants consisting of dissolved metals other than zinc which, otherwise, might be co-deposited with the metal zinc during the electrodeposition step.

Cementation (or precipitation by chemical shift) is the reaction through which a first metal is precipitated in the elemental state from a solution that contains it in the form of ions by adding, to the solution, a second metal in the elemental state (precipitating agent) having a lower reduction potential (or more negative) than the reduction potential of the first metal.

In the cementing unit, metal zinc is used as a precipitating agent 123 to precipitate dissolved metals having a higher reducing potential than zinc in the electrochemical series. The metal zinc is added in dust form to the leachate in a quantity in excess of that of the metals to be precipitated, for example in a quantity from 30% to 200% in excess of the stoichiometric quantity necessary to precipitate the metal ions contained in the leachate. The quantity of soluble zinc ions resulting from the addition of metal zinc is negligible compared to the quantity of zinc ions resulting from leaching metallurgical wastes.

As said, metal zinc used as a precipitating agent, in addition to zinc in the elemental state, can contain iron impurities in significant quantities, for example up to 3-4 g of iron per kg of zinc. Since iron introduced into the leachate can be removed together with manganese, it is possible to use metal zinc even of not particularly high purity as a precipitating agent. Preferably, the metal zinc contains iron in a quantity up to 0.1% by weight, up to 0.5% by weight or up to 1% by weight (concentration expressed in terms of iron in the elemental state referred to the weight of the precipitating agent).

Cementation can be performed in one or more stages in sequence, depending on the total content and the type of metal contaminants to be removed.

Cementation can be carried out with the techniques and devices known to those skilled in the art. In a preferred embodiment, cementation is carried out continuously in a revolving reactor. This reactor and the relative methods of use are known to those skilled in the art.

The cementing step generates a biphasic product constituted by a purified leachate 125 and a solid product (cement) 127. The purified leachate 125 comprises zinc ions and a residual quantity of metal ions other than zinc that were initially present in the incoming leachate 119. The cement 127 comprises the precipitated metals in the elemental state other than zinc having a higher reduction potential than zinc, in particular Pb, Cd, Cu, Ag, and unreacted metal zinc. In the purified leachate 125, the concentration of manganese ions present in the leachate remains substantially identical to the concentration in the incoming leachate 119, since the reduction potential of the $Mn^{2+}/Mn$ pair is lower than that of the $Zn^{2+}/Zn$ pair under the conditions in which cementation is carried out.

Preferably, the total concentration of ions of metals other than zinc, including manganese, in the leachate 119 entering the cementing unit 103 is within the range 100 mg/l-3,000 mg/l. Preferably, the total concentration of ions of the metals other than zinc, excluding manganese and iron, in the purified leachate 125 is within the range of 0.5 mg/l-2 mg/l. Preferably, in the purified leachate 125 the concentration of manganese ions is within the range 10 mg/l-2,000 mg/l, more preferably within the range 20 mg/l-1,500 mg/l. Preferably, in the purified leachate 125 the concentration of iron ions is within the range 1 mg/l-50 mg/l.

In accordance with the embodiment shown in FIG. 1, the purified leachate 125, after being separated from the metal cement 127, for example by decanting and/or filtration, is subjected to an oxidation treatment in the oxidation unit 105 to oxidize the manganese ions in solution and to form insoluble $MnO_2$. The oxidation of manganese ions is obtained by adding permanganate ions 129 to the purified leachate 125. The addition of permanganate ions 129 in the oxidation unit 105 may be made alternatively or in combination with the addition of permanganate ions 118 in the leaching unit 101.

The oxidation reaction of manganese ions in solution can take place, for example, according to the following scheme:

$$3\ Mn(NH_3)_xCl_2+2\ KMnO_4+2\ H_2O \rightarrow 5\ MnO_2+4\ HCl+2\ KCl+3x\ NH_3 \quad (12)$$

where x is an integer within the range 1-6.

In the presence of soluble iron ions in the leachate, the formation of the $MnO_2$ ions is accompanied by the reaction of the $MnO_4^-$ ions with the iron ions with formation of insoluble iron hydroxides and of further $MnO_2$, for example according to the following reaction:

$$3\ Fe(NH_3)_xCl_2+KMnO_4+7\ H_2O \rightarrow MnO_2+3\ Fe(OH)_3+5\ HCl+KCl+3x\ NH_3 \quad (13)$$

where x is an integer within the range 1-6.

The oxidation step carried out in the unit 105 generates a biphasic reaction product comprising an insoluble residue 131 and a treated leachate 133 having a reduced concentration of manganese ions and iron ions with respect to the concentration in the incoming leachate 125.

The insoluble residue 131 comprises the precipitated manganese in the form of $MnO_2$ and optionally the iron oxides and hydroxides precipitated during the oxidation step. Since generally the concentration of iron ions in the leachate subjected to oxidation with permanganate ions is relatively low with respect to the concentration of manganese ions, the resulting $MnO_2$ has a high degree of purity (equal to or higher than 95% by weight and up to 99% by weight) and it is therefore reusable as a raw material in other industrial processes.

In one embodiment, the precipitate 131 comprising $MnO_2$ is washed with an acid aqueous solution, having for example pH within the range 1.5-3. This washing allows removing any iron oxides and hydroxides from the $MnO_2$ precipitate, thus increasing the degree of purity of the obtained $MnO_2$.

The permanganate ions 129 and/or 118 are preferably added in the form of an aqueous solution, for example an aqueous solution of $KMnO_4$. In a preferred embodiment, the quantity of added $MnO_4^-$ ions is adjusted so as to maintain substantially the redox potential value of the treated leachate 133 exiting from the unit 105 constant.

The dosage of the $MnO_4^-$ ions can be adjusted, for example, by periodically or continuously measuring the redox potential of the treated leachate exiting from the oxidation unit 105 and by adjusting the dosage of the oxidizing agent (manually or automatically) so as to maintain the redox potential value of the treated leachate within a predetermined range (reference range). The reference range can be determined experimentally by those skilled in the art for the particular plant in which the method according to the present invention is carried out, such range of values being able to be influenced mainly by factors such as the composition of the leachate, temperature, pH, material forming the electrodes.

The leachate 133, substantially free of manganese ions and iron ions, exiting from the oxidation unit 105 is fed to the electrodeposition unit 109 for the recovery of zinc.

Irrespective of the point of the process in which the precipitation of manganese ions and the removal of the precipitated $MnO_2$ is carried out, preferably, the residual concentration of manganese ions in the leachate circulating in the cell is lower than 2 mg/l. Preferably, the residual concentration of iron ions in the leachate circulating in the cell is lower than 1 mg/l.

It has been observed that in some cases the addition of permanganate ions does not allow to guarantee the ideal condition of concentration of $Mn^{2+}$ ions in the electrolytic cell, that is, to respect the condition of concentration $Mn^{2+}<2$ mg/l or lower, and therefore a higher current efficiency of the cell. This drawback can occur both when the dosage of the permanganate ions is carried out by keeping the redox potential of the leachate constant, even in a continuous and automated way, and when the permanganate ions are dosed in stoichiometric excess with respect to the concentration of manganese ions and iron ions to be precipitated.

The dosage of the permanganate ions in stoichiometric excess, in principle, has the advantage of precipitating these two impurities substantially completely, without increasing the concentration of manganese ions in the leachate. The unreacted permanganate ions, in fact, are destined to be converted into $MnO_2$ by reacting with ammonia and thus removed from the leachate in the form of precipitate. However, the presence of impurities in the leachate, in variable and unpredictable concentrations, which oxidize in the presence of the permanganate ions together with the slow kinetics of the reaction of conversion of the permanganate ions into $MnO_2$ in the presence of ammonia, lead to an incomplete precipitation of $MnO_2$ and, consequently, to the permanence of a residual concentration of manganese ions in the leachate which upon reaching the cell can adversely affect the electrodeposition process, in particular if metal anodes are used.

The Applicant has now found that it is possible to overcome this drawback by adjusting the dosage of the permanganate ions so as to maintain the redox potential of the leachate at an optimal value—hereinafter also indicated "precipitation redox potential" or "$Redox_{ppt}$"—corresponding to the value in which the added permanganate ions completely oxidize all the oxidizable species present in the leachate, to the specific pH value thereof, preferably to the specific pH and temperature values thereof.

The precipitation redox potential can be determined experimentally, either on the plant or in the laboratory, by carrying out a series of redox titrations of aliquots of the leachate containing the manganese and/or iron ions to be removed, using a solution of permanganate ions as a titration agent; the aliquots of the leachate are subjected to titration to different pH values to take into account the possible variations of the values of this parameter during the process; the pH of the aliquots of leachate to be titrated can be adjusted by the additions of a basifying agent (e.g. $NH_4$) or acidifying agent (e.g. HCl) in order to reach the desired pH.

Preferably, at least two, more preferably at least three, even more preferably at least four, samples having different pH values are prepared. Typically, the number of samples is within the range from 2 to 8. Preferably, the titration of these samples is carried out by keeping the sample at the operating temperature of the process, e.g., 70° C.

Preferably, the aliquots of the leachate are subjected to titration to different pH and temperature values to take into account the effects of the variations of both operating conditions on the precipitation redox potential.

To this end, at least two samples having different pH values are preferably prepared, each of which is titrated to at least two different temperature values, so as to have at least four experimental values of precipitation redox potential. More preferably, the number of samples prepared is at least three, even more preferably at least four. Preferably, each sample is titrated to at least three different temperatures, preferably, each sample is titrated to at least four different temperatures.

The experimental $Redox_{ppt}$ values are obtained by determining the inflection point of the titration curve, i.e., the inflection points of the graph which reports the redox potential values of the solution as a function of the volume of titrating agent added.

The experimental values of redox potential, pH and optionally temperature are mathematically interpolated to obtain a calibration curve $Redox_{ppt}=f(pH)$ or $f(pH, T)$, which correlates the precipitation redox potential to pH and optionally to the temperature (T) of the leachate. The interpolation can be carried out by means of known mathematical methods, for example by means of a three-dimensional polynomial function.

Using the calibration curve, the precipitation redox potential can be calculated based on the pH values and possibly on the temperature of the leachate measured during the execution of the process. By periodically repeating the procedure for determining the $Redox_{ppt}$ value, it is possible to modify the dosage of the permanganate ions to guarantee the optimal precipitation conditions of the manganese ions, thus avoiding to dose the permanganate ions in defect with respect to the manganese ions, with consequent incomplete precipitation of the manganese ions from the solution, or in excess, with consequent entrainment of the not converted manganese species into $MnO_2$ to the electrolysis cell.

The $Redox_{ppt}$ value may vary as a result of different factors and parameters of plant conduction, such as pH, temperature, composition of metallurgical wastes, etc. however, it has been observed that optimizing the $Redox_{ppt}$ value on the basis of pH, preferably pH and temperature, of the leachate is sufficient to obtain the substantially complete precipitation of the manganese ions.

The calibration curve of the $Redox_{ppt}$ parameter, if necessary or desired, can be however determined by taking into account also other parameters of the plant conduction, in addition to pH, such as current density applied to the electrodes, content of iron ions in the leachate, presence of other redox pairs (e.g., $Au/Au^+$, $Ag/Ag^+$), etc., in a manner similar to that described above for pH and temperature.

In general, the $Redox_{ppt}$ value can vary in wide ranges. In at least one embodiment, the $Redox_{ppt}$ value varies within the range 400-650 mV (measured with a Pt-based electrode relative to a reference electrode, such as a saturated calomel electrode or AgCl). The pH preferably varies within the range from 5.2-7, more preferably from 5.5-6.5. The temperature preferably varies within the range from 60° C.-80° C.

The aforesaid method for controlling the conditions of precipitation of manganese ions can be applied to the addition of permanganate ions irrespective of the position in which this addition is carried out in the process for treating metallurgical wastes, for example in the leaching solution, in the purified leachate or in the exhausted leachate.

Advantageously, the aforesaid method for controlling the conditions of precipitation of manganese ions can be carried out in combination with a continuous and automatic dosing system of the permanganate ions.

In one embodiment, the dosing system comprises: a device for dosing the permanganate ions (e.g. pump for feeding a $KMnO_4$ solution); a redox sensor for measuring the redox potential of the leachate to be treated with the permanganate ions; a pH sensor and optionally a temperature sensor for measuring these two parameters on the leachate to be treated; a control unit (e.g. a programmable logic unit, PLC) connected to the sensors to receive and process the results of redox potential, pH and temperature measurements. The control unit is also connected to the dosing device to control the quantity of permanganate ions dosed in response to a set $Redox_{ppt}$ value. The logic unit is programmed with the calibration curve $Redox_{ppt}$=f(pH) or f(pH, T) experimentally determined to calculate and periodically set a $Redox_{ppt}$ values to be maintained in the leachate on the basis of the pH values and optionally temperature values detected by the sensors during the process.

During the process, following a permanganate ion dosing, the sensors send the redox potential, pH and optionally temperature values measured on the leachate to the control unit. The control unit calculates the optimal $Redox_{ppt}$ value based on the programmed calibration curve and sets this value as the set point value to be maintained in the leachate. The control unit then controls the dosing device to feed the permanganate ions so as to bring the redox potential of the leachate to the set $Redox_{ppt}$ value (for example, by increasing or reducing the quantity of permanganate ions dosed). The aforesaid control process is repeated periodically, possibly continuously and in an automated mode.

In one embodiment, the method according to the present invention thus comprises:

a. dosing permanganate ions to the leachate comprising zinc ions and manganese ions;
b. measuring at least pH, redox potential and optionally temperature of said leachate;
c. periodically, calculating a precipitation redox potential value ($Redox_{ppt}$ by means of a calibration curve which correlates the precipitation redox potential to at least pH values and optionally the leachate temperature;

varying the dosage of the permanganate ions so as to bring the redox potential value of the leachate to the calculated precipitation redox potential value ($Redox_{ppt}$).

The electrodeposition unit 109 comprises at least one electrolytic cell (not shown in the FIGURE) comprising at least one cathode and at least one anode immersed in the leachate to be electrolysed.

In accordance with the scheme of FIG. 1, the leachate 133 to be electrolysed, before being fed to the electrolytic cell, is accumulated in a recycling tank 107. A leachate stream 135 is withdrawn from the recycling tank 107 and is circulated in the electrolytic cell of the electrodeposition unit 109. During electrolysis, the application of an electrical potential difference to the electrodes causes the reduction of the zinc ions present in the leachate and the formation of a metal zinc particulate, which adheres to the cathode surface.

The exhausted leachate 137, whose concentration of zinc ions is reduced compared to the incoming leachate 133, exiting from the electrolytic cell is recirculated again to the recycling tank 107 where it is mixed with the leachate 133 coming from the oxidation unit 105.

In one embodiment, an aliquot 159 of the leachate present in the recycling tank 107 is withdrawn and recycled to the leaching unit 101, where it is enriched with zinc ions following the leaching of further metallurgical wastes, so as to carry out the zinc recovery process continuously.

When the recovery process of metal zinc in continuous mode is in steady state conditions:

(i) the mass per unit time of metal Zn deposited to the cathode (current 143) is preferably approximately equal to the difference between the mass in the unit of time of $Zn^{2+}$ ions entering the recycling tank 107 (current 133) and the mass in unit of time of $Zn^{2+}$ ions in the exhausted leachate 137 which is recirculated to the recycling tank 107;

(ii) the volumetric flow rate of the recirculated leachate in the electrolytic cell (streams 135, 137) is preferably about equal to the volumetric flow rate of the recirculated leachate 159 to the leaching unit 101 (streams 159, 119, 125, 133). Under steady state conditions, the concentration of $Zn^{2+}$ ions in the tank 107 is therefore substantially constant.

Electrolysis may be carried out in an open cell according to the techniques known to those skilled in the art, for example as described in U.S. Pat. Nos. 5,534,131A and 5,534,131A.

The composition of the electrolytic solution, which contains $Cl^-$ and $NH_4^+$ ions, allows obtaining the deposition of metal zinc to the cathode and the evolution of gaseous chlorine to the anode. The gaseous chlorine which has just formed, and which is still adsorbed on the electrode reacts rapidly with the ammonium ions present in solution around the anode, regenerating ammonium chloride with evolution of gaseous nitrogen. The electrochemical reactions that take place during electrolysis are the reactions (3) to (6) illustrated above. Since the electrolysis reaction consumes $NH_3$, this is optionally integrated in the process by feeding it to the electrolytic cell (FIG. 1, arrow 141), for example in the form of an ammonia aqueous solution.

The zinc deposited on the cathode is separated from the latter (FIG. 1, arrow 143) and optionally processed, for example by melting to dispose it in the form of ingots; the metal zinc can also be recovered in dust form, a part of which can be used as a precipitating agent in the cementation step.

In one embodiment, the electrolytic cell comprises at least one graphite anode.

In another embodiment, the electrolytic cell comprises at least one activated metal anode. The activated metal anodes usable for the purposes of the present invention are known to those skilled in the art and commercially available.

Preferably, the aforesaid activated metal anode comprises at least one electrically conductive substrate (e.g., Ti, Nb, W and Ta) covered with a catalytic coating layer comprising one or more noble metals and/or one or more oxides of a noble metal.

The cathode can be made of various materials, such as titanium, niobium, tungsten, and tantalum. Preferably, the cathode is made of titanium.

In order to control the concentration of impurities in the leachate circulating in the continuous process, the leachate contained in the tank 107 is preferably subjected to a regeneration treatment to remove, in particular, at least one of the following components: calcium ions, magnesium ions, halide ions, alkaline and/or alkaline-earth metal ions, water.

The control of the concentration of these impurities allows controlling the formation of incrustations (in particular calcium and magnesium salts) on the heat exchangers used in the plant.

In one embodiment, the leachate regeneration treatment comprises a carbonation step. For this purpose, an aliquot 139 of the leachate present in the tank 107 is fed to the carbonation unit 111, where, by adding at least one precipitating agent 145 selected from: carbonate of an alkaline and/or alkaline-earth metal, hydrogen carbonate of an alkaline and/or alkaline-earth metal, and mixtures thereof (e.g. $Na_2CO_3$ and/or $NaHCO_3$), the calcium ions and magnesium ions are removed, causing them to precipitate in the form of the respective insoluble carbonate and/or hydrogen carbonate salts (reaction 7). The insoluble precipitate 147 thus formed is separated, for example by filtration, from the supernatant solution 149 which is sent to the tank 107.

In an alternative embodiment, the control of the concentration of calcium ions and magnesium ions in the leachate circulating in the process can be carried out in the leaching unit 101 by adding anions capable of forming insoluble calcium and/or magnesium salts under the pH and temperature conditions of the leachate.

Preferably, the aforesaid anions are selected from: sulphate, carbonate, and oxalate.

Preferably the anions are sulphate anions $SO_4^{2-}$, which can be added to the leachate in the leaching unit, for example in the form of an aqueous solution of sulphuric acid. The carbonate and oxalate anions can be added to the leachate in the leaching unit, for example in the form of an aqueous solution of sodium oxalate or sodium carbonate. The sulphate anions form a precipitate comprising calcium sulphate and magnesium sulphate, which is removed together with the insoluble residue 117. The sulphuric acid solution can be an aqueous solution of the type available on the market, having for example a concentration within the range 20-96% by weight. In view of the composition of the ammonium chloride-based leaching solution, the addition of sulphuric acid in the quantity necessary to precipitate calcium ions and magnesium ions does not result in significant changes in the pH of the solution present in the leaching unit 101.

It should be noted that the carbonation unit in the EZINEX® process according to the state of the art also performs the function of controlling the concentration of $Mn^{2+}$ ions in the leachate circulating in the process. Since the method according to the present invention provides for the substantially complete removal of soluble manganese ions from the leachate by oxidation with permanganate ions, when the control of the concentration of calcium ions and magnesium ions is carried out through their precipitation in the leaching unit, it is possible to eliminate the carbonation unit, thus reducing the size of the plant and simplifying the management thereof.

In one embodiment, the regeneration treatment comprises a step of heat treating the leachate. For this purpose, an aliquot 155 of the solution present in the tank 107 is fed to the evaporation unit 113 where part of the excess water accumulated during the process (dilution water of the reagents, washing water of the filtration residues) is removed by thermal treatment. The removed water is driven away in the form of a vapour stream 151. Water evaporation may cause precipitation of alkali and/or alkaline-earth metal halide salts (e.g., NaCl and KCl), which are separated (arrow 153) from the supernatant by sedimentation and/or filtration. The supernatant solution 157 comprising the concentrated leachate is sent to the tank 107.

The following experimental example is provided below to further illustrate the features and advantages of the present invention.

Example 1

The efficiency of the method described herein has been tested on a pilot plant realised according to the scheme of FIG. 1. The productivity of the pilot plant, in the absence of the oxidation unit, was about 8 kg/h of metal zinc.

The test was carried out by circulating the leachate in the plant with a flow rate of about 600 l/h.

The oxidation unit comprised a tank containing an aqueous solution of $KMnO_4$ (40 g/l) and a pump for withdrawing the solution from the aforesaid tank and for mixing it with the leachate circulating inside the oxidation unit. The oxidation unit also comprised a filter press to separate the solid $MnO_2$ particulate formed after the addition of $KMnO_4$.

The feeding flow rate of the $KMnO_4$ solution to the leachate was adjusted so as to maintain the redox potential of the latter constant. The pump flow rate was adjusted automatically, through a pump control device, on the basis of the redox potential of the leachate exiting from the oxidation unit. The pump control device was configured to activate and modulate the flow rate of the $KMnO_4$ based on the redox potential value measured for the leachate exiting from the oxidation unit so as to keep it at a value of 300 mV (electrode of Pt measurement; saturated calomel reference electrode).

The leachate entering the oxidation unit contained 357 mg/l of manganese ions 6 mg/l of dissolved iron ions. During the test, the average $KMnO_4$ feeding flow rate was about 10.5 l/h. The duration of the test was 2 hours.

1320.5 g of particulate were recovered from the oxidation unit by pressure filtration. The particulate, after washing with water and drying, weighed 1139.6 g. After drying, the dried particulate contained 62.3% by weight of manganese, equivalent to 98.6% of $MnO_2$, and 0.91% of iron oxides/hydroxides. The filtered leachate entering the electrolysis unit had a total content of dissolved manganese ions and iron ions lower than 1 mg/l. Visual inspection showed no significant presence of particulate in the cell during electrolysis.

The electrolysis unit comprised two electrolytic cells connected in series each comprising five titanium cathodes (each having a working surface of 1 $m^2$) and 6 graphite anodes.

Upon 2 hours of electrolysis carried out with a current density of 350 $A/m^2$, a total deposit of 16.76 kg of metal zinc (current efficiency 98.2%) having a purity degree equal to 99.992% was recovered at the cathodes.

The current efficiency, i.e., the ratio between the quantity of zinc deposited and the quantity of zinc theoretically depositable according to Faraday's law, passed from an average of 94%-95% (with a maximum value of 96%) for the process carried out in the absence of the oxidation unit to a value stably equal to or higher than 98% in the presence of the oxidation unit according to the present invention.

Example 2

The test of example 1 was repeated by adjusting the feeding flow rate of the $KMnO_4$ solution to the leachate so as to maintain the redox potential constantly at the optimal $Redox_{ppt}$ value determined on the basis of the pH and T values of the leachate. For this purpose, a calibration curve was prepared by titrating 3 aliquots of leachate with a solution of $KMnO_4$ (3.16 g/l), each at pH=5.2, 6.0 and 7.0 and temperature=60° C., 70° C. and 80° C.

The following table shows the experimental $Redox_{ppt}$ value (end-of-titration points) obtained for each sample.

TABLE

Calibration curve of $Redox_{ppt}$ = f(pH, T)

| | | pH | | |
|---|---|---|---|---|
| | | 5.2 | 6.0 | 7.0 |
| Temp. | 60° C. | 602 | 521 | 443 |
| | 70° C. | 572 | 491 | 420 |
| | 80° C. | 583 | 496 | 404 |

The experimental $Redox_{ppt}$ values were mathematically interpolated by means of a polynomial function obtaining a calibration curve $Redox_{ppt}$=f(pH, T), with which the pump control unit was programmed. By performing the dosage of the permanganate ions by continuously adjusting the redox potential value of the leachate to the $Redox_{ppt}$ value, it was possible to feed a leachate containing a Mn concentration of around 0.2 mg/L to the electrolysis cell. Under these conditions zinc was electrodeposited with a current efficiency equal to 99.2%. Moreover, the electrolysis solution showed no traces of dust, remaining perfectly clear.

The invention claimed is:

1. A method for recovering metal zinc from a solid metallurgical waste comprising zinc and manganese, the method comprising:

(a) bringing the solid metallurgical waste into contact with an aqueous leaching solution comprising chloride ions and ammonium ions to produce at least one leachate comprising zinc ions and manganese ions and at least one insoluble solid residue;

(b) cementing the at least one leachate by adding metal zinc as a precipitating agent, to eliminate at least one metal other than zinc and manganese optionally present in the at least one leachate as ions and producing a purified leachate;

(c) precipitating the manganese ions by oxidation with permanganate ions to form a precipitate comprising $MnO_2$, and subsequently separating the precipitate; and (d) electrolyzing the purified leachate in an electrolytic cell, comprising a cathode and an anode immersed in the purified leachate, to deposit metal zinc on the cathode and producing at least one exhausted leachate, wherein the precipitating (c) is conducted in the bringing (a) or after the cementing (b) and before the electrolyzing (d), and wherein the precipitating (c) comprises:

(i) dosing permanganate ions to the at least one leachate comprising zinc ions and manganese ions;

(ii) measuring at least pH, redox potential, and optionally temperature of the at least one leachate;

(iii) periodically calculating a precipitation redox potential value by a calibration curve which correlates the precipitation redox potential to at least pH values and optionally the at least one leachate temperature; and (iv) varying dosage of the permanganate ions so as to bring the redox potential value of the at least one leachate to the calculated precipitation redox potential value.

2. The method of claim 1, wherein the precipitating (c) is carried out after the cementing (b) and before the electrolyzing (d).

3. The method of claim 1, wherein the precipitating (c) is carried out in the bringing (a), by adding the permanganate ions to the leaching solution.

4. The method of claim 1, wherein at least one part of the exhausted leachate exiting from the electrolyzing (d) is recycled as a leaching solution to the bringing (a).

5. The method of claim 1, wherein the permanganate ions are in the form of an aqueous solution.

6. The method of claim 1, wherein the permanganate ions added in the precipitating (c) are adjusted in quantity, continuously or discontinuously, so as to maintain the value of the redox potential of the at least one leachate exiting from the precipitating (c) in a range of reference values.

7. The method of claim 1, wherein the precipitate further comprises an iron oxide.

8. The method of claim 1, wherein the precipitate is washed with an acid aqueous solution having a pH in a range of from 1.5 to 3.

9. The method of claim 1, wherein the leaching solution has a pH in a range of from 5 to 9.

10. The method of claim 4, wherein the exhausted leachate is fed to the bringing (a) after being treated to remove at least partly: calcium ions, magnesium ions, halide ions, alkali metal ions, alkaline-earth metal ions, and/or water.

11. The method of claim 1, wherein the leaching solution in the bringing (a) comprises anions capable of forming insoluble calcium and/or magnesium salts.

12. The method of claim 1, wherein the anode is an activated metal anode.

13. The method of claim 1, wherein the anode is a graphite anode.

14. The method of claim 1, wherein the cementing (b) is carried out continuously in at least one rotary reactor.

15. The method of claim 1, wherein the calibration curve is obtained by redox titration of the at least one leachate at two or more different pH values and two or more different temperature values.

16. The method of claim 1, wherein the anode is an activated metal anode.

17. The method of claim 1, wherein the permanganate ions are in the form of an aqueous solution of $KMnO_4$.

* * * * *